US009239155B2

(12) United States Patent
Chung et al.

(10) Patent No.: US 9,239,155 B2
(45) Date of Patent: Jan. 19, 2016

(54) LIGHTING APPARATUS

(71) Applicant: Sang Min Chung, Gangnam-gu, Seoul (KR)

(72) Inventors: Sang Min Chung, Seoul (KR); Hyeon Seong Jeong, Seongnam-si (KR)

(73) Assignee: San Min Chung (KR)

( * ) Notice: Subject to any disclaimer, the term of this patent is extended or adjusted under 35 U.S.C. 154(b) by 6 days.

(21) Appl. No.: 14/369,378

(22) PCT Filed: Dec. 28, 2012

(86) PCT No.: PCT/KR2012/011794

§ 371 (c)(1),
(2) Date: Jun. 27, 2014

(87) PCT Pub. No.: WO2013/100729

PCT Pub. Date: Jul. 4, 2013

(65) Prior Publication Data

US 2014/0347847 A1 Nov. 27, 2014

(30) Foreign Application Priority Data

Dec. 29, 2011 (KR) ..... 10-2011-0146111

(51) Int. Cl.
*F21S 8/00* (2006.01)
*F21S 13/12* (2006.01)
(Continued)

(52) U.S. Cl.
CPC ..... *F21V 21/28* (2013.01); *F21S 6/003* (2013.01); *F21S 8/032* (2013.01); *F21S 8/033* (2013.01); *F21V 21/02* (2013.01); *F21V 21/06* (2013.01); *F21V 21/26* (2013.01); *F21Y 2101/02* (2013.01)

(58) Field of Classification Search
CPC ..... F21S 8/033; F21S 8/036; F21S 8/037; F21S 8/032; F21S 6/00–6/008; F21V 21/02; F21V 21/06; F21V 21/26–21/30
See application file for complete search history.

(56) References Cited

U.S. PATENT DOCUMENTS 2,665,870 A 1/1954 De Weiss
3,604,923 A * 9/1971 Moffatt ..... F21V 21/26 362/427

(Continued)

FOREIGN PATENT DOCUMENTS

AT DE 4303290 A1 * 10/1993 ..... F21V 21/26
DE 19853494 5/1999

(Continued)

OTHER PUBLICATIONS

International Search Report, Application No. PCT/KR2012/011794, dated Apr. 24, 2013.

(Continued)

*Primary Examiner* — Mariceli Santiago
(74) *Attorney, Agent, or Firm* — Perman & Green, LLP

(57) ABSTRACT

Provided is a lighting apparatus. The lighting apparatus includes a base unit, a first rod-shaped member, a lighting unit and a base connection unit, wherein the base connection unit includes, a rotating member rotatably coupled to the base part, a base cam fixed to the rotating member and including a base cam through-hole that penetrates a central portion of the base cam; a main shaft disposed in the base cam through-hole, capable of performing a tilt operation for rotating in one direction and the other direction on the basis of a tilt rotation central axis orthogonal to the lengthy direction of the first rod-shaped member, and having an upper portion to which the one end of the first rod-shaped member is coupled and fixed, and an elastic member that is provided to change an elastic bearing power applied to the main shaft, as the main shaft is tilted.

12 Claims, 15 Drawing Sheets

(51) Int. Cl.

| | |
|---|---|
| ***F21V 21/06*** | (2006.01) |
| ***F21V 21/28*** | (2006.01) |
| ***F21V 21/02*** | (2006.01) |
| ***F21V 21/26*** | (2006.01) |
| ***F21S 6/00*** | (2006.01) |
| *F21Y 101/02* | (2006.01) |

(56) References Cited

U.S. PATENT DOCUMENTS

| | | | | |
|---|---|---|---|---|
| 4,770,384 | A | 9/1988 | Kuwazima et al. | |
| 5,092,552 | A * | 3/1992 | Dayton | F21V 21/28 248/278.1 |
| 6,164,612 | A | 12/2000 | Schmitt | |
| 6,536,731 | B1 * | 3/2003 | Tegland | F21V 21/06 248/309.2 |
| 6,592,241 | B1 * | 7/2003 | Kovacik | F21V 21/06 362/275 |
| 6,733,159 | B1 * | 5/2004 | Wu | F21V 21/06 362/289 |

FOREIGN PATENT DOCUMENTS

| | | |
|---|---|---|
| GB | 995170 | 6/1965 |
| JP | 5699710 | 12/1954 |
| JP | 55105905 | 8/1980 |
| JP | 6026725 | 2/1985 |
| JP | 2101198 | 8/1990 |
| JP | 9512328 | 12/1997 |
| JP | 2000348528 | 12/2000 |
| JP | 2010182452 | 8/2010 |
| KR | 20050076424 | 7/2005 |
| KR | 20100123529 | 1/2011 |
| KR | 20110002994 | 3/2011 |
| WO | 9529345 | 11/1995 |

OTHER PUBLICATIONS

European Search Report, European Application No. 12863136, dated Sep. 8, 2015.

* cited by examiner (a)

(b)

(a)

(b)

(a)

(b)

LIGHTING APPARATUS

CROSS-REFERENCE TO RELATED APPLICATIONS

This application is the National Stage of International Application No. PCT/KR2012/011794 having International filing date 28 Dec. 2012, which designated the United States of America, and which International Application was published under PCT Article (s) as WO Publication 2013/100729 A1 and which claims priority from, and the benefit of, Korean Application No. 10-2011-014611, filed on 29 Dec. 2011, the disclosures of which are incorporated herein by reference in their entireties.

BACKGROUND

The presently disclosed embodiment relates to a lighting apparatus, and more particularly, to a lighting apparatus having an improved structure of a connection unit in order to allow a user to change position of a lighting unit more conveniently and smoothly.

In general, lighting apparatuses include various light sources such as fluorescent lamps, incandescent lamps, and LED bulbs, and their specific forms vary.

Among such lighting apparatuses, a lighting apparatus such as a ceiling lamp is installed on a ceiling of a house or an office to light up a wide range of an area, and a light apparatus such as a table stand is used to light up a relatively small range of an area.

Especially, a lighting apparatus such as a table stand is put on a desk or a floor, or its base unit is fixed on a wall during use. When a user reads a book or lighting for a limited space is required by a certain need, such a lighting apparatus is widely used as a necessary illumination for a necessary place because its lighting unit including a light source is movable.

A lighting apparatus such as a table stand typically includes a base unit, a support unit protruding from the top of the base unit, and a lighting unit connected to an end portion of the support unit and having a light source to emit light.

Especially, a portion connecting the base unit and the support unit and a portion connecting the support unit and the lighting unit include a movable connection unit such as a joint, respectively. Since such a connection unit is provided, the lighting unit may be adjusted to a desired position by changing an angle of the support unit with respect to the base unit if necessary.

However, a lighting apparatus including a connection unit as in a typical table stand may have limitations in conveniently moving the position of a lighting unit as it is needed by a user, due to an unsatisfied operation of a joint connecting a base unit and a support unit, i.e. its structural limitations of an entire configuration and the connection unit. That is, it is inconvenient to move the position of a lighting unit.

SUMMARY

The presently disclosed embodiment provides a solution to resolve the issues that a lighting apparatus such as a typical table stand including a connection unit has, and thus, provides a lighting apparatus that allows a user to easily, conveniently, and smoothly move a lighting unit to a desired position with less power.

According to an aspect of the disclosed embodiment, there is provided a lighting apparatus including: a base unit placed on a floor or fixed on a wall; a first rod-shaped member having one end coupled to the base unit and having a long shape in a lengthy direction; a lighting unit installed at the other end of the first rod-shaped member and including a light source for emitting light; and a base connection unit provided in the base unit and coupled to the one end of the first rod-shaped member, wherein the base connection unit includes: a rotating member rotatably coupled to the base unit; a base cam fixed to the rotating member and including a base cam through-hole that penetrates a central portion of the base cam; a pillar-shaped main shaft disposed in the base cam through-hole, capable of performing a tilt operation for rotating in one direction and the other direction on the basis of a tilt rotation central axis orthogonal to the lengthy direction of the first rod-shaped member, and having an upper end portion to which the one end of the first rod-shaped member is coupled and fixed; and an elastic member that is provided to change an elastic bearing power applied to the main shaft, as the main shaft is tilted.

The main shaft may have a hollow cylindrical form and may have a main shaft through-hole penetrating a lower portion of the main shaft; the main shaft may further include a cam shaft therein; a lower portion of the cam shaft may pass through the main shaft through-hole and extends; the lower portion of the cam shaft may further include a base cam ball holder including a holder extension unit protruding toward a direction vertical to the lengthy direction of the cam shaft; the lighting apparatus may further include a cam unit protruding toward an inside of the base cam through-hole, contacting the holder extension unit, and having an inclined plane whose distance to the tilt rotation central axis is changed gradually; the elastic member may be disposed in the inside of the main shaft, and the degree of the elastic deformation of the elastic member may be changed according to a change of the distance between the base cam ball holder and the tilt rotation central axis as the cam shaft moves; and while the main shaft is tilted, the deformation degree of the elastic member may be changed simultaneously as the holder extension unit moves along the cam unit, an elastic bearing power applied to the main shaft by the elastic member may be changed.

The cam shaft may have an elongated body portion and a head portion having an expanded diameter at an upper end of the body portion; the elastic member may be a coiled spring and may be inserted into the body portion of the cam shaft to be pressed by the head portion of the cam shaft; and the elastic member may be pressed and elastically deformed further by the head portion of the cam shaft, as the cam shaft moves and the base cam ball holder fixed to the lower end of the body portion of the cam shaft moves in a direction away from the rotation central axis.

When a tilt operation of the main shaft is made toward the front of a user, the holder extension unit may become progressively away from the main shaft through-hole and the elastic member may be further elastically deformed.

The inclined plane of the cam unit may be formed downward; and at least one metal sphere-shaped holder ball that allows a relative movement of both sides to be smooth or at least one cylindrical holder cylinder may be provided between the holder extension unit and the inclined plane of the cam unit.

A tilt angle limiting stopper unit limiting a range of a tilt operation toward the front and rear sides of the main shaft may be formed on at least one of the rotating member and the base cam.

With a screw thread formed at the lower end of the cam shaft and coupled to a nut, the elastic member, the cam shaft, and the base cam ball holders may be mutually coupled to each other.

The lighting apparatus may further include a first fixing member fixed to the base part and rotatably fixing and supporting the rotating member.

The lighting apparatus may further include a second fixing member disposed on the bottom of the rotating member and fixed to the base unit to fix and support the lower side of the rotating member, wherein the lower side of the rotating member and the upper side of the second fixing member may face each other mutually, and at least two metal sphere-shaped rotating member balls that allow a rotating movement of the rotating member to be smooth may be provided between the lower side of the rotating member and the upper side of the second fixing member.

The rotating member may have a rotating member through-hole penetrating a central portion of the rotating member; the rotating member may include a plate-shaped cover member for covering the rotating member through-hole and moving with respect to the rotating member; a cover member through-hole penetrating the main shaft may be formed in the cover member; and the cover member may move together with the main shaft inserted into the cover member through-hole as the main shaft is tilted, and may be configured to prevent a penetrated portion of the rotating member through-hole from being exposed to the outside.

In order to limit a rotation angle of a rotational movement with respect to the base unit of the rotating member, a rotation angle limiting protruding unit may be formed at one of the base unit and the rotating member, and a rotation angle limiting stopper unit protruding to limit a movement of the protruding unit may be formed at the other one of the base unit and the rotating member.

An elongated second rod-shaped member may be connected to the other end of the first rod-shaped member and the first and second rod-shaped members are mutually connected to each other by a middle connection unit; and the lighting unit may be coupled to an end portion of the second rod-shaped member.

According to a lighting apparatus of the present invention, the position of a lighting unit is moved to a desired position smoothly with less power.

DETAILED DESCRIPTION

Hereinafter, aspects of the presently disclosed embodiment will be described in more detail with reference to the accompanying drawings.

Referring to FIGS. 1 to 11, the lighting apparatus of the presently disclosed embodiment may be implemented into a table stand mainly put on a desk, but is not limited thereto. That is, it is possible to make various modifications adapting a configuration of a connection unit.

That is, a lighting apparatus having a configuration in which a base unit is fixed on a wall, a connection unit is operated, and a lighting unit is moved to a desired position may be implemented. Additionally, a floor lighting apparatus having an elongated first rod-shaped member and a base part put on the floor of an indoor space instead of a desk may be implemented.

Figure 1:
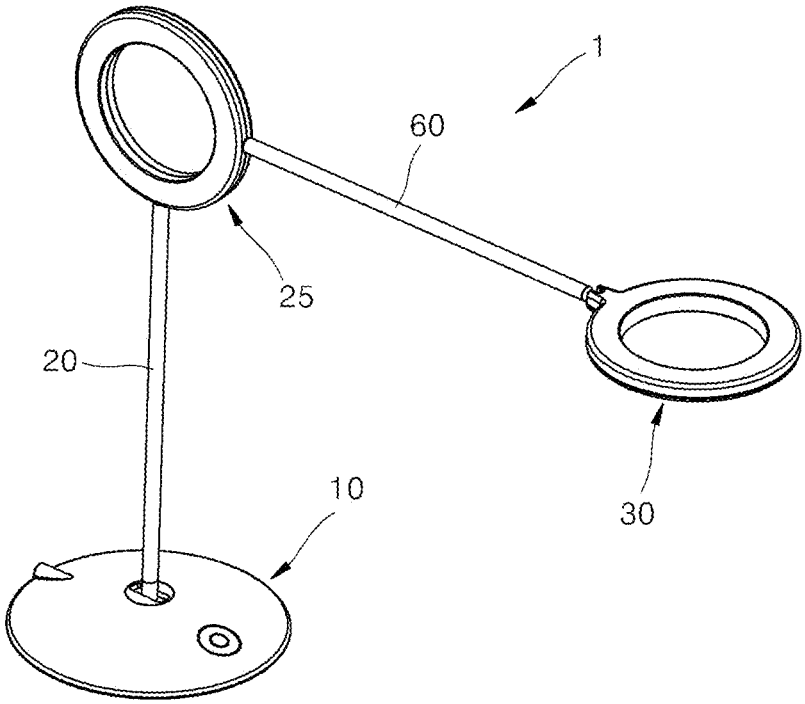
FIG. 1 is a perspective view of a lighting apparatus according to an aspect of the presently disclosed embodiment.
Figure 2:
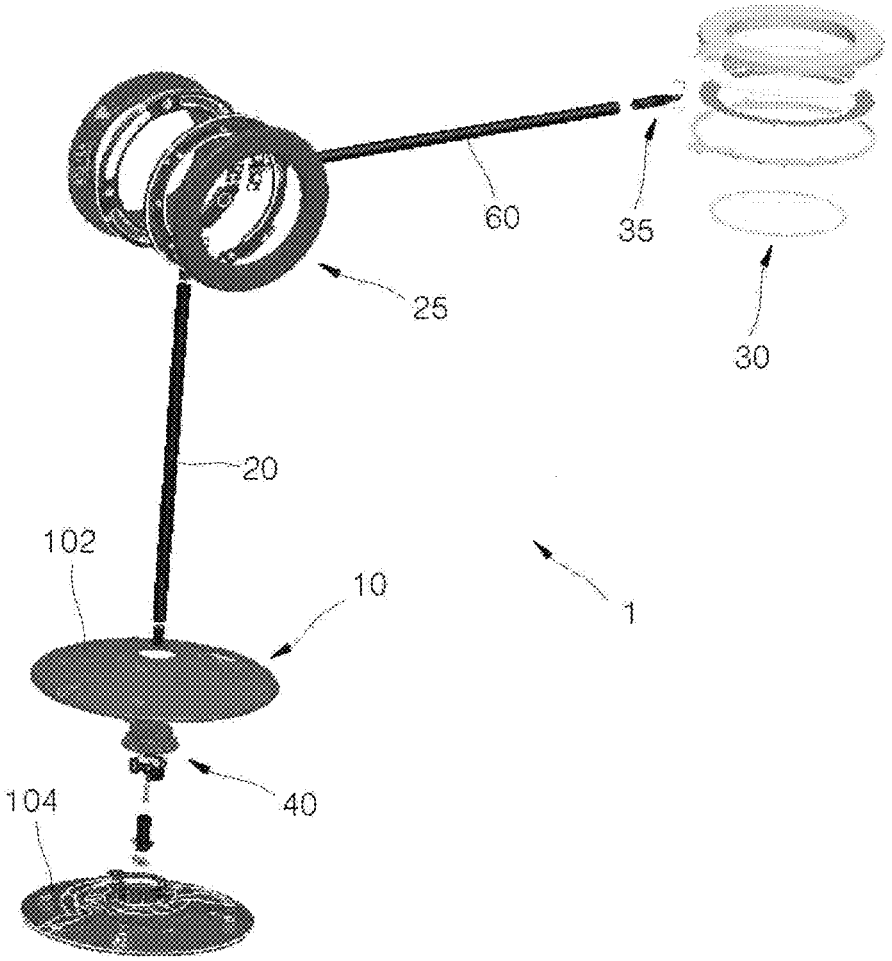
FIG. 2 is a partially exploded perspective view of a lighting apparatus according to an aspect of the presently disclosed embodiment.

The lighting apparatus 1 of FIG. 1, as a lighting apparatus for a table stand mainly put on a desk or a table, may include a base unit 10, a first rod-shaped member 20, a lighting unit 30, and a base connection unit 40.

The base unit 10 is put on the top surface of a desk in use and other elements configuring the lighting apparatus are connected to and supported by the base unit 10. In another aspect, the base unit may be fixed on a wall during use, and may be used on the floor of an indoor space.

In this aspect, the base unit 10 includes an upper case 102 and a lower case 104, which are mutually coupled to each other. The upper case 102 may be coupled to the lower case 104 and may be detachable from the lower case 104. Moreover, a switch unit for controlling an on/off operation and illumination of a light source is installed at one side of the upper case 102. The lower case 104 may be made heavily in order to provide stability during operations of other elements fixed to the base unit 10.

The first rod-shaped member 20 is a thin member having a long shape in a lengthy direction with a lower portion, i.e. its one end, which is coupled to the base unit 10. The first rod-shaped member 20 may be a hollow pipe or may be a pole member having a cross-section of a circular or polygonal shape.

The lighting unit 30 is disposed at the other end, i.e. the top end, of the first rod-shaped member 20. The lighting unit 30 of the lighting apparatus of FIG. 1 is installed at the other end of the first rod-shaped member with a second rod-shaped member 60 therebetween. Moreover, according to an aspect of the disclosed embodiment, the lighting unit 30 may be directly connected to the other end of the first rod-shaped member 20. In addition, according to an aspect of the disclosed embodiment, the lighting unit may be directly fixed to the other end of the first rod-shaped member without a re-locatable configuration such as a joint unit or a connection unit.

The lighting unit 30 includes a light source emitting light when electricity is supplied. In the case of this aspect, the light source includes a plurality of LED bulbs. In the case of another aspect of the disclosed embodiment, the light source may include typical fluorescent lamps, incandescent lamps, and halogen lamps.

The base connection unit 40 is installed at the base unit 10 and is coupled to a lower portion, i.e. one end, of the first rod-shaped member 20.

The base connection unit 40 includes a rotating member 41, a base cam 42, a main shaft 43, and an elastic member 44. With the base connection unit 40, the first rod-shaped member 20 may rotate with respect to the base unit 10 and especially, may tilt (i.e. an inclining operation may be performed).

The rotating member 41 may be rotatably coupled to the base unit 10. In the case of this aspect, the rotating member 41 may be rotatably coupled to the base unit 10 by a first fixing member 52.

That is, the first fixing member 52 is fixed to the upper case 102 configuring the base unit 10 by four screw members 522, but the outer circumference of a portion where the diameter of the rotating member 41 is reduced, is inserted into and supported by a penetrating portion formed in the central portion of the upper case 102. Accordingly, the rotating member 41 may rotate with respect to the base unit 10.

Additionally, in the case of this aspect, a second fixing member 53 is further installed at the bottom of the rotating member 41. The second fixing member 53 supports the bottom surface of the rotating member 41 and is fixed to the case 104 forming the bottom of the base unit 10. Additionally, according to an aspect of the disclosed embodiment, the second fixing member 53 may be coupled to the first fixing member 52.

Furthermore, although the bottom surface of the rotating member 41 and the top surface of the second fixing member 53 face each other, four balls 412, i.e. rotating members having a metal spherical shape, are installed between the bottom surface of the rotating member 41 and the top surface of the second fixing member 53 in order to allow a rotational movement of the rotating member 41 to be smooth.

That is, four metal balls are put on the top surface of the second fixing member 53 fixed to the base unit 10, at the mutually same intervals along a circle, and the rotating member 41 is put on the metal balls. The metal balls serve just as the balls in a typical bearing unit. Moreover, at least two rotating member balls may be provided or five or six rotating member balls may be provided according to the need. In the case of this aspect, a rotating member through-hole 414 that is penetratively formed is disposed at the central portion of the rotating member 41. The main shaft 43 passes through the through-hole 414. In the case of this embodiment, the through-hole has a substantially long rectangular form that allows a tilt operation of the main shaft 43.

The rotating member 41 includes a cover member 54. The cover member 54 serves to prevent foreign materials from entering the inside space of the base connection unit 40 through the rotating member through-hole 414.

When the main shaft 43 moves with a tilt operation in the rectangular rotating member through-hole 414, it is configured to cover the remaining portions open to the outside, except for a portion the main shaft 43 occupies among the open surface of the rotating member through-hole 414.

The cover member 54 is a thin plate-shaped member having a size to cover the rotating member through-hole 414. The cover member 54 has a cover member through-hole 542 to penetrate the main shaft 43. Both end portions in a lengthy direction of the cover member 54 may be slidable through slits 416 at both sides of the rotating member 41.

Figure 3:
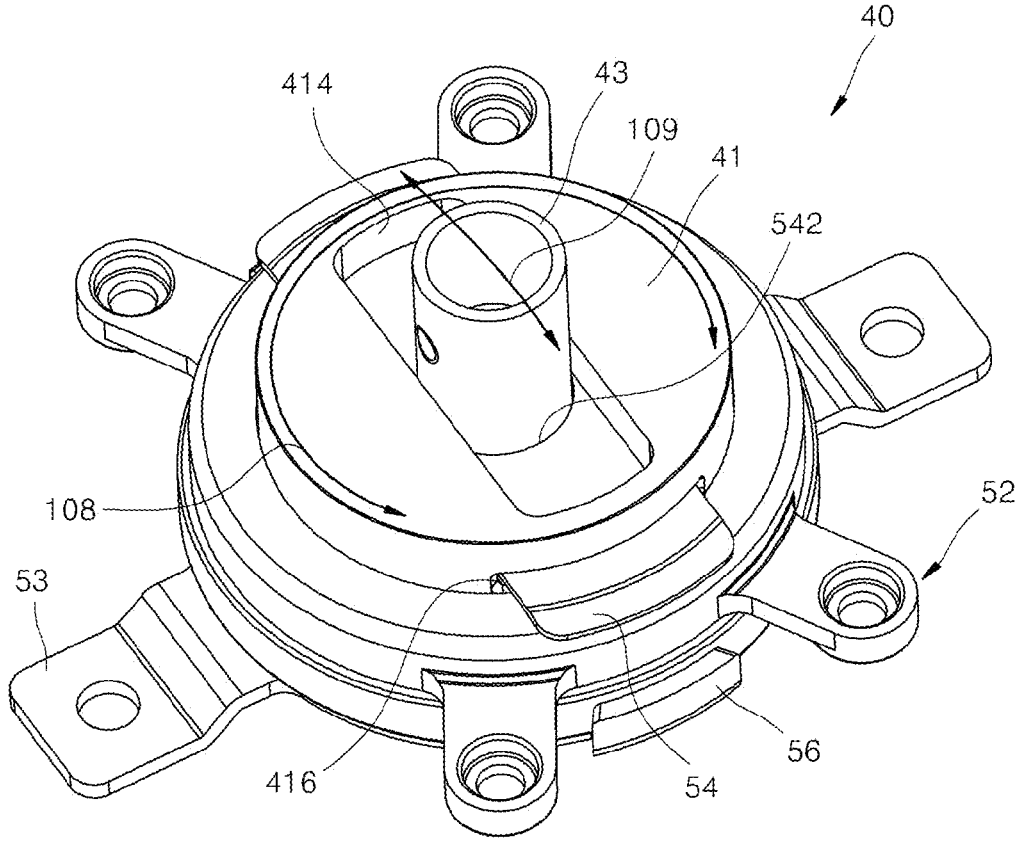
FIG. 3 is a perspective view illustrating a base connection unit of FIG. 2.

That is, referring to FIG. 3, the cover member 54 moves with the main shaft 43 guided by the slits 416 of the rotating member 41 and inserted into the cover member through-hole 542, as the main shaft 43 is tilted and moved in a direction of an arrow 109, thereby preventing an open portion of the rotating member through-hole 542 from being exposed to the outside.

Additionally, in the case of this aspect, a rotation angle with respect to the base unit 10 of the rotating member 41 is limited. A rotation angle of the rotating member 41 is limited to within a range of about 300°. For this, a rotation angle limiting protruding unit 56 is formed at the outer circumference of the rotating member 41, and a rotation angle limiting stopper unit 58 is formed at the second fixing member 53 fixed to the base unit 10. The positions and sizes of the protruding unit and the stopper unit have no restriction.

The base cam 42 is fixed and installed to the rotating member 41 by screws 424. That is, as the rotating member 41 rotates with respect to the base unit 10, the base cam 42 rotates together with the rotating member 41. A base cam through-hole 422 penetrating in a vertical direction is disposed at the middle portion of the base cam 42. The main shaft 43 penetrates into the through-hole 422 in order for installation.

In the case of this aspect, a cam unit 47 protruding toward the central portion of the base cam through-hole 422 is installed at the inside thereof. The cam unit 47 is protrudingly formed to contact a holder extension unit 462 and to have an inclined plane where the distance to a tilt rotation central axis C2 is gradually changed. A specific form of the inclined plane 472 of the cam unit 47 that changes the distance may be modified in consideration of the degree of pressing the elastic member 44 according to an aspect of the disclosed embodiment.

Additionally, in the case of this aspect, the inclined plane 472 is formed downward.

Referring to FIG. 9B, in relation to the distance from the tilt rotation central axis C2 to the inclined plane 472 of the cam unit 47, the distance between a second point P2 and the tilt rotation central axis C2 is longer than the distance between a first point P1 and the tilt rotation central axis C2, and the distance between a third point P3 and the tilt rotation central axis C2 is longer than the distance between the second point P2 and the tilt rotation central axis C2. The inclined plane 472 of the protruding cam unit is formed, in a manner that distance to the rotation central axis is gradually increased.

The main shaft 43 is a hollow pillar form and is disposed lengthily in the base cam through-hole 422 up and down. That is, the main shaft 43 has a cylindrical form with the top entirely open and a main shaft through-hole 432 is formed in the middle portion of the lower portion of the main shaft 43.

The main shaft 43 is configured to perform a tilt operation that rotates in one direction and the other direction (refer to an arrow 109 of FIG. 3) on the basis of the tilt rotation central axis orthogonal to the lengthy direction C1 of the first rod-shaped member 20.

The lower portion, i.e. one end, of the first rod-shaped member 20 is fixed and coupled to the upper portion of the main shaft 43. Seating protruding portions 434 that are protrudingly formed to be coupled to seating grooves in the inside of the through-hole 422 of the base cam 42 are installed at both sides of the bottom of the main shaft 43. The seating protruding portions 434 have a semi-circular cylindrical form.

The main shaft 43 is rotatably coupled to the base cam 42 by two rotation axis pins 435 penetrating the base cam 42 and the seating protruding portions 434 so as to be inserted at both the sides of the main shaft 43.

The elastic member 44 is installed to allow an elastic bearing power applied to the main shaft 43 to be changed as the main shaft 43 performs a tilt operation. Moreover, in the case of this aspect, the elastic member 44 is a coiled spring. The spring is inserted into a cam shaft body portion 454 and is pressed by a head portion 456.

In the case of this aspect, the main shaft 43 has a hollow cylindrical form. A main shaft through-hole 432 penetrating up and down is disposed at the lower portion of the main shaft 43.

Figure 4:
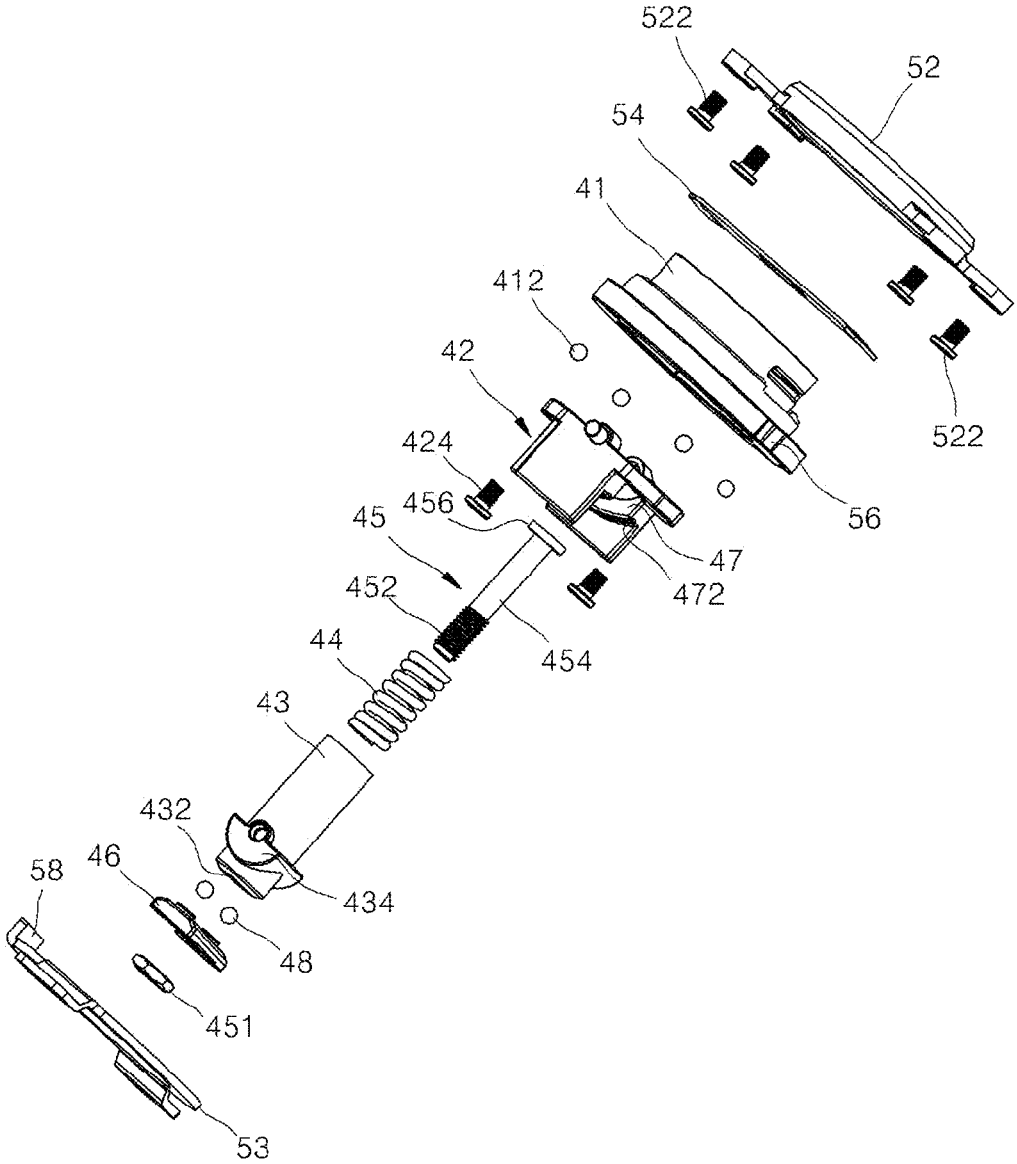
FIG. 4 is an exploded perspective view of the base connection unit of FIG. 3.
Figure 5:
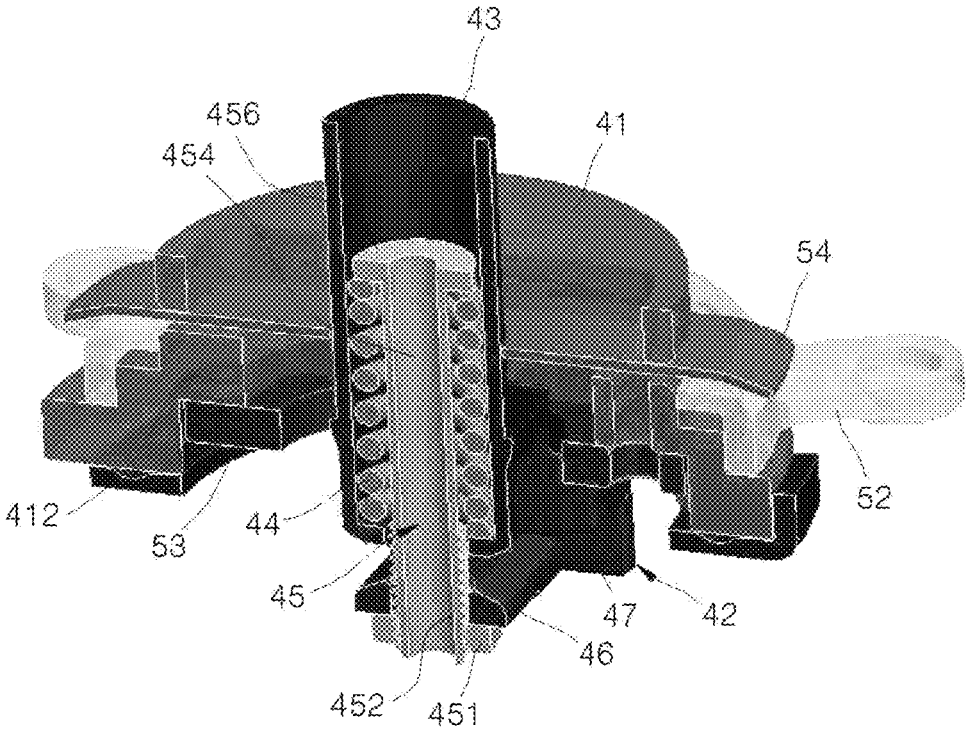
FIG. 5 is a stereoscopic cross-sectional view of FIG. 3.
Figure 6:
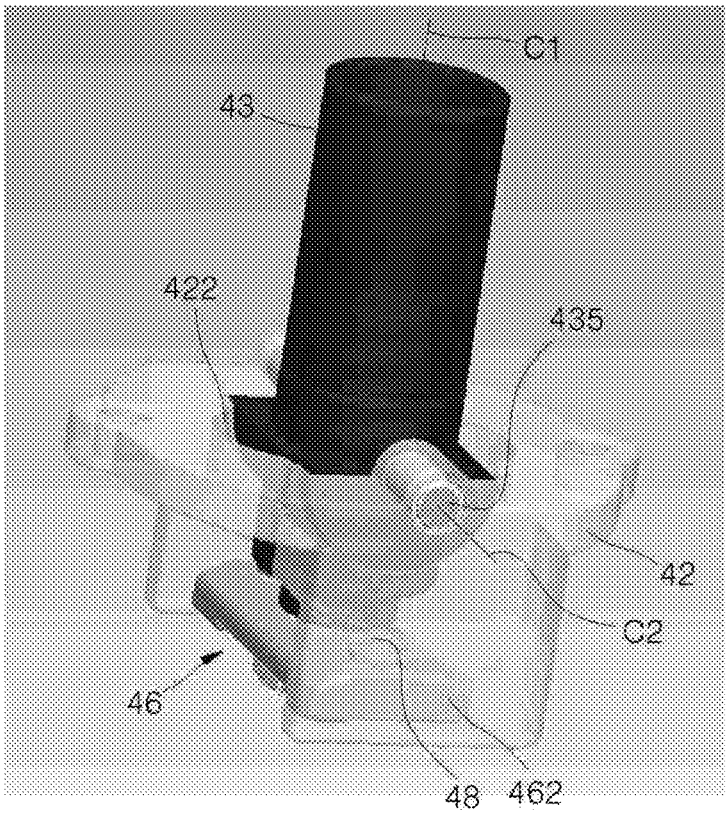
FIG. 6 is a perspective view illustrating a base cam and a main shaft of FIG. 3.
Figure 7:
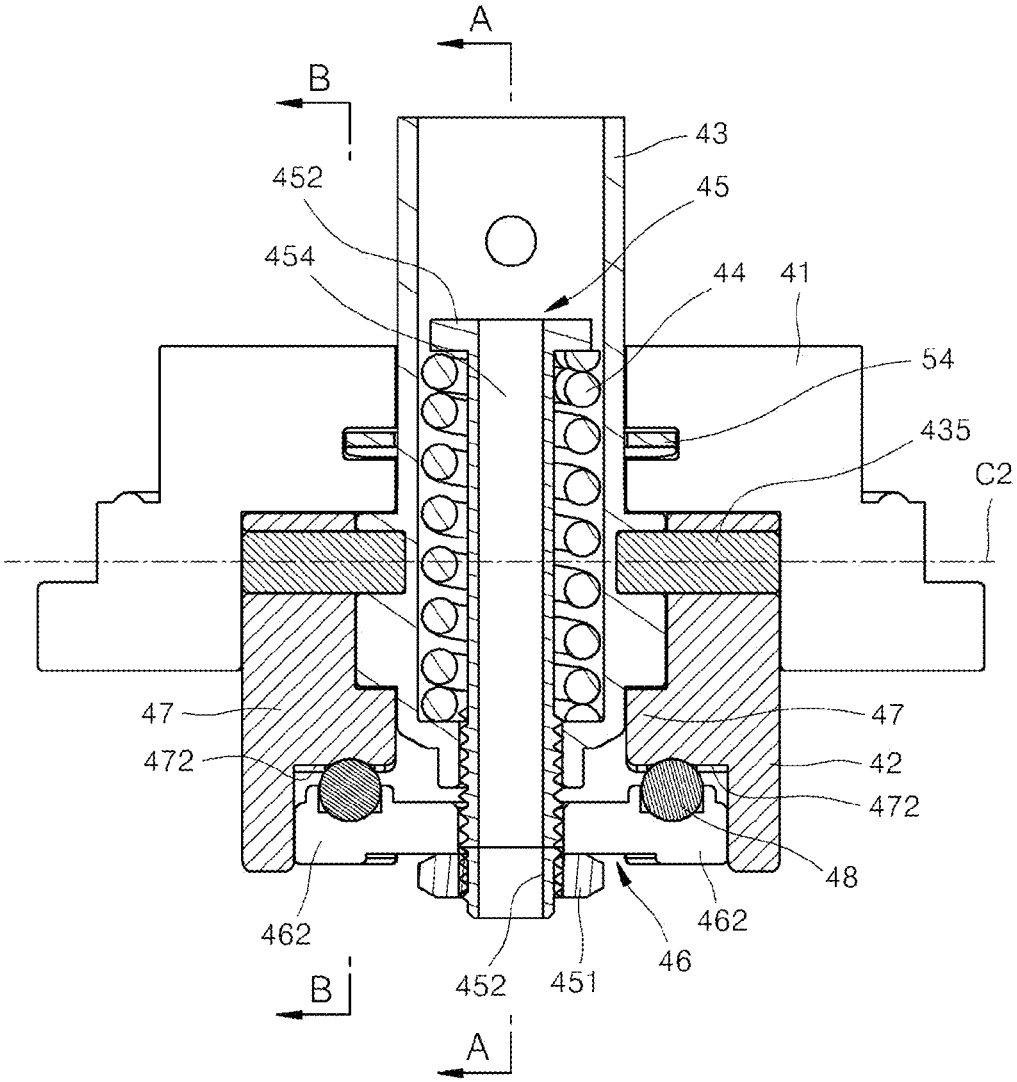
FIG. 7 is a cross-sectional view of FIG. 3.

Additionally, a cam shaft 45 is installed at the inside of the main shaft 43. Referring to FIG. 4, the cam shaft 45 includes an elongated body portion 454 and a head portion 456 having an expanded diameter at the upper portion of the body portion 454. The lower portion 452 of the cam shaft 45 extends, passing through the main shaft through-hole 432.

A base cam ball holder 46 is coupled to the lower portion 452 of the cam shaft 45. The base cam ball holder 46 includes a pair of holder extension units 462 protruding toward both sides thereof in a direction vertical to the lengthy direction of the cam shaft 45.

The holder extension unit 462 is configured to contact the inclined plane 472 of the cam part 47 and move under the guidance of the inclined plane 472, while contacting the inclined plane 472, during a tilt operation of the main shaft. Moreover, in the case of this aspect, one holder ball 48 having a metal spherical form, which makes a relative movement of both sides of the holder extension unit 462 and the cam unit 47 smooth, is provided at each of both sides of the holder extension unit 462 and the cam unit 47, i.e. total two holder balls are provided between the holder extension unit 462 and the inclined plane 472 of the cam unit 47.

Additionally, a screw thread is formed at the lower portion 452 of the cam shaft 45 and a nut 451 is coupled to the screw thread. In such a configuration, the elastic member 44, the cam shaft 45, and the base cam ball holder 46 are mutually coupled to each other.

Additionally, a tilt angle limiting stopper unit 51 that limits a range of a tilt operation toward the front and rear sides of the main shaft 43 is disposed in the inside of the through-hole 422 of the base cam 42. The stopper unit 51 has a groove form, and a tilt angle limiting protruding unit 50 is formed in the outer circumference of the main shaft 43.

Moreover, the elastic member 44 is disposed at the inside of the main shaft 43, and the degree of its elastic deformation is changed according to a change of the distance between the base cam ball holder 46 and the rotation central axis C2 when the cam shaft 45 moves in an axial direction.

Accordingly, when the main shaft 43 coupled with the first rod-shaped member 20 is tilted, the holder extension unit 462 moves along the cam unit 47 and also the degree of deformation in the elastic member 44 is changed simultaneously. Due to this, an elastic bearing power applied to the main shaft 43 by the elastic member 44 is changed.

In the case of this aspect, the elastic member 44 is pressed by the head portion 456 of the cam shaft, and thus is further elastically deformed, when the cam shaft 45 moves in an axis direction and the base cam ball holder 46 fixed to the lower portion 452 of the body portion 454 of the cam shaft 45 moves in a direction away from the rotation central axis C2.

Moreover, in the case of this aspect, when the lighting apparatus 1 is put on a user's desk and the main shaft 43 is tilted toward the front side of the user, the elastic member 44 is further pressed as the holder extension unit 462 is progressive away from the rotation central axis C2.

Moreover, according to this aspect, in the case of the lighting apparatus 1, the second rod-shaped member 60 is connected to the other end of the first rod-shaped member 20. The first rod-shaped member 20 and the second rod-shaped member 60 are mutually connected to each other through a middle connection unit 25.

Additionally, the lighting unit 30 is coupled to an end portion of the second rod-shaped member 60. The lighting unit 30 and the second rod-shaped member 60 are mutually connected to each other through a lighting connection unit 35.

Hereinafter, the action and effect of the lighting apparatus 1 having the above configuration are described.

Since the lighting apparatus 1 includes the rotating member 41 rotatably coupled to the base unit 10, the main shaft 43 fixed to the rotating member 41 to move along with the rotating member 41 may rotate in the direction of the arrow 108 of FIG. 3.

In relation to a rotational operation, when a natural rotation is made by the rotating member 41 and the first fixing member 52, in order to minimize the frictional resistance, the rotating member ball 412 is inserted into the lower side of the rotating member 41 to provide a rolling action on the second fixing member 53, so that rotation is more easily achieved.

At this point, a rotatable range may be confined within a desired range due to the configuration of the rotation angle limiting protruding unit and the stopper units 56 and 58.

A tilt operation of the main shaft 43 is described. The elastic member 44 and the base cam ball holder 46 are configured by a nut 451 coupled to the lower portion of the cam shaft 45. Accordingly, as the main shaft 43 is tilted, the cam shaft 45 disposed in the main shaft 43 and tilted along with the main shaft 43 moves along the inclined plane 472 of the cam unit 47.

At this point, due to a distance difference between the base cam ball holder 46 and the tilt rotation central axis C2, compression and tensile are applied to the elastic member so that equilibrium of force is maintained for every interval. That is, the continuously tilting power of the main shaft 43 tilted due to the weight of a portion including the lighting unit 30, the elastic resilience of the elastically deformed elastic member 44, and the frictional force of the mutually contacting surfaces provide mutual balance to allow the lighting unit 30 to stay at a desired position.

Figure 8:
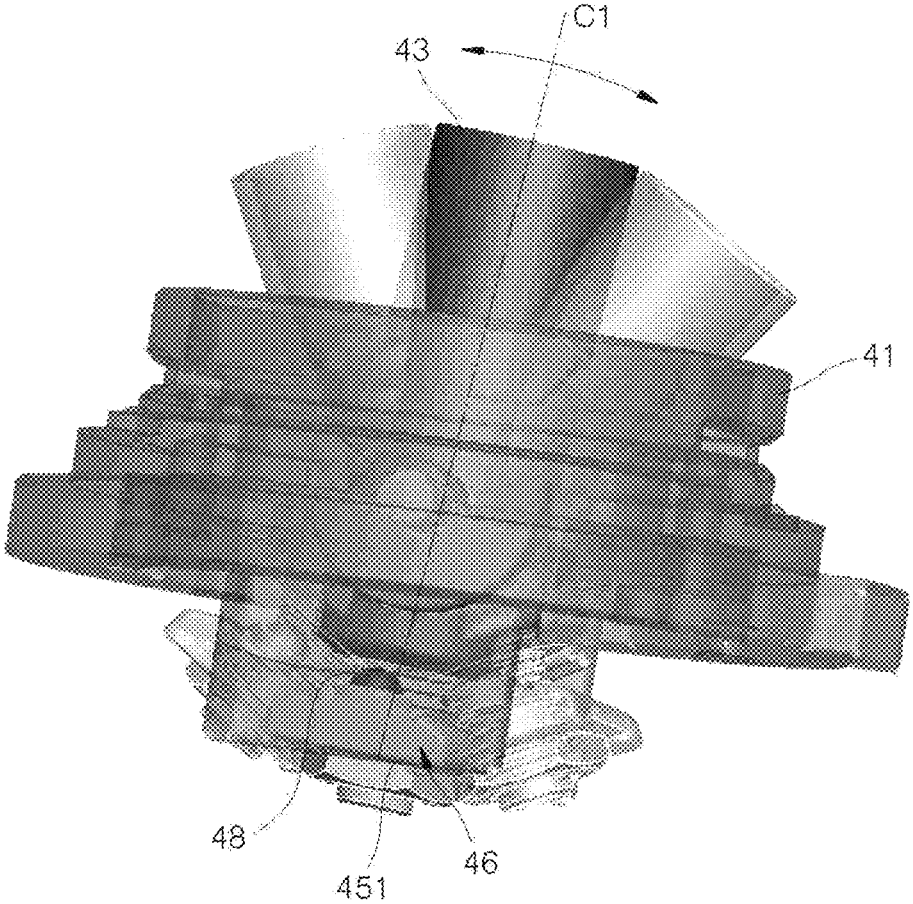
FIG. 8 is a perspective view illustrating a tilt operation of a main shaft of FIG. 3.
Figure 9:
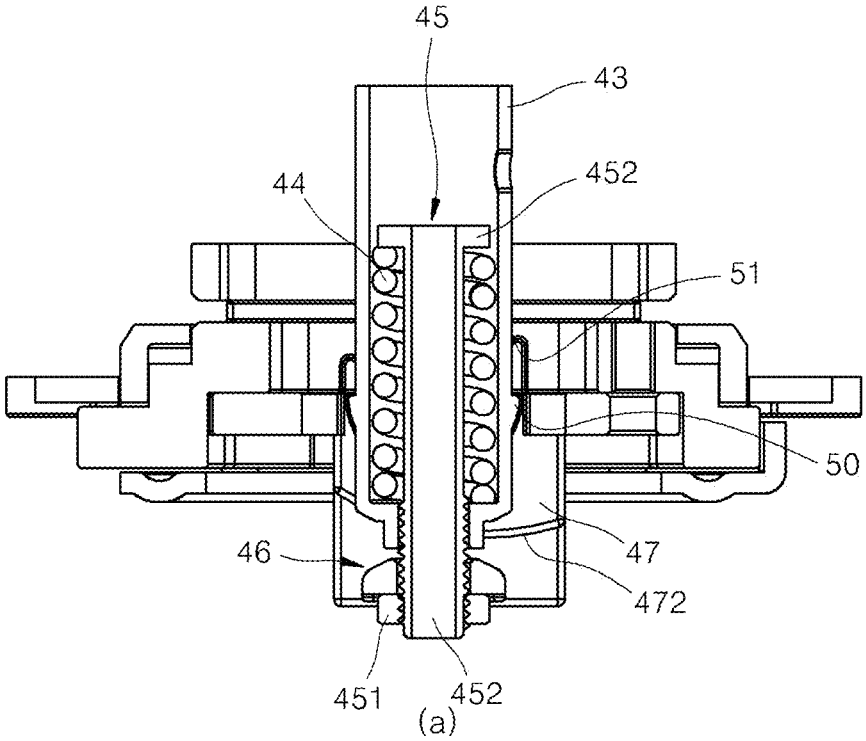
FIGS. 9 to 11 are cross-sectional views illustrating a tilt operation of a main shaft.
Figure 9:
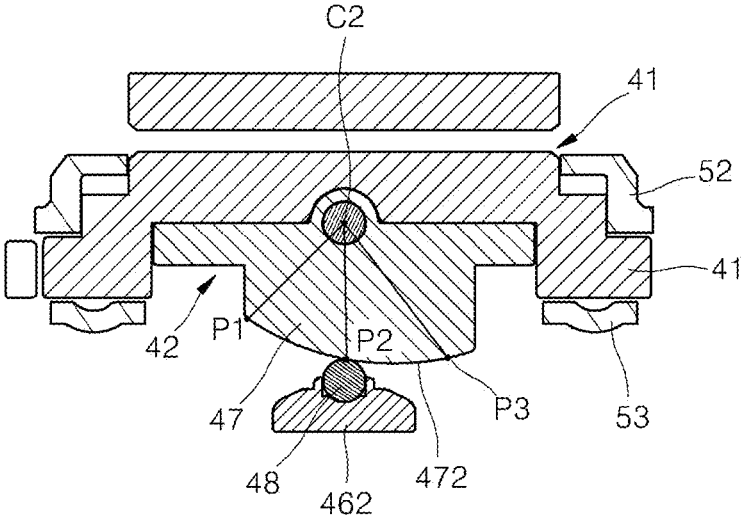
Figure 10:
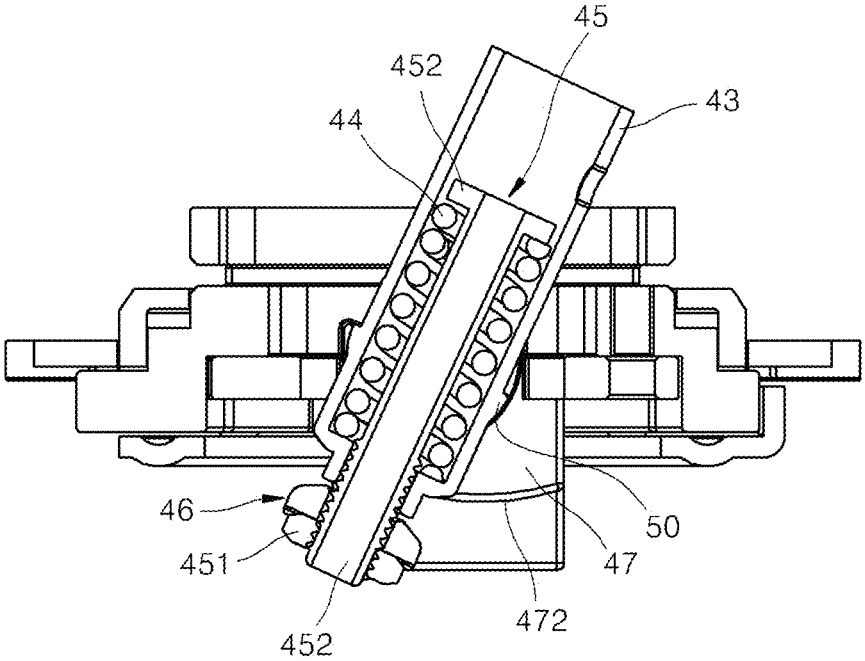
Figure 10:
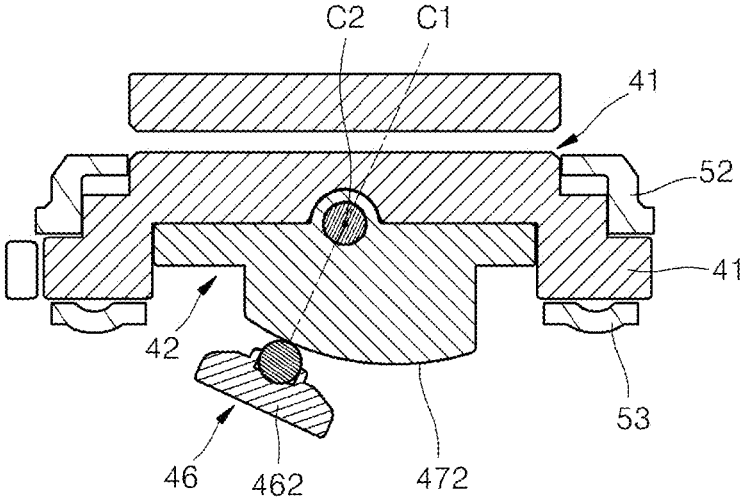
Figure 11:
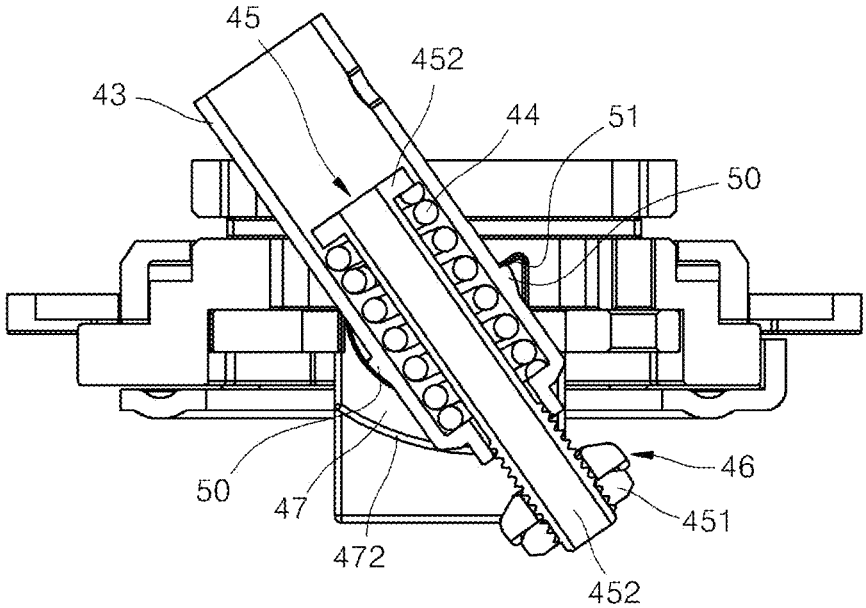
Figure 11:
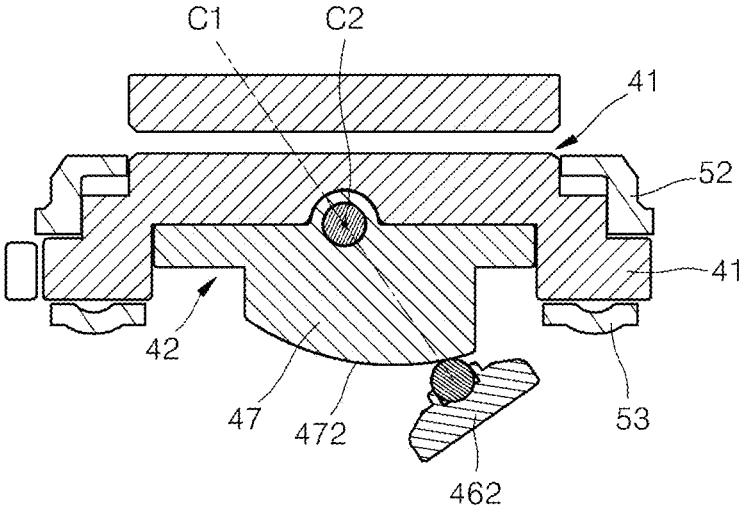

FIG. 8 is a view when the main shaft 43 is tilted continuously on the basis of the tilt rotation central axis C2. With reference to FIGS. 9A and 10A and FIGS. 9B and 10B illustrating the cross-sectional views taken along lines A-A and B-B of FIG. 7, respectively, an operation of the main shaft 43 is described.

FIGS. 9A and 9B illustrate a vertical state of the main shaft 43. The base cam 42 is fixed to the rotating member 41. The elastic member 44 is pressed to a certain extent when the holder ball 48 contacts the inclined plane 472 of the cam unit 47.

FIGS. 10A and 10B are views when the main shaft 434 in a vertical state is tilted in a direction away from a user, i.e. when it is tilted to the rear side. As the holder extension unit 462 of the base cam ball holder 46 coupled to the lower portion 452 of the cam shaft 45 moves to the left of FIG. 10B along the inclined plane 472 of the cam unit 47, the distance between the base ball holder 46 and the tilt rotation central axis C2 is reduced. Due to this, the elastic deformation degree of the elastic member 44 was slightly reduced when compared with FIG. 9.

FIGS. 11A and 11B are views when the main shaft 434 in a vertical state is tilted in a direction closer to a user, i.e. when it is tilted to the front side. As the holder extension unit 462 of the base cam ball holder 46 coupled to the lower portion 452 of the cam shaft 45 moves to the right of FIG. 11B along the inclined plane 472 of the cam unit 47, the distance between the base ball holder 46 and the tilt rotation central axis C2 is increased. Due to this, as the head portion 456 of the cam shaft descends, it presses the elastic member 44 so that its elastic deformation is increased.

According to the tilt operation mechanism described with reference to FIGS. 9A to 11B, the balance of power is achieved when the main shaft 43 is tilted at a specific position. Additionally, while the main shaft 43 makes up the balance of power at a specific point, if a user wants to change the position of the lighting unit 30, i.e. when a user wants to change the inclination degree of the main shaft 43, only very little power need to be applied to the first rod-shaped member connected to the main shaft or directly applied to the lighting unit. The reason is because this is related to the elastic deformation of the elastic member 44.

Additionally, an operable angle during a tilt operation of the main shaft 43 is about 30° toward the front side of a user with respect to the vertical axis and is about 25° toward the rear side thereof with respect to the vertical axis. This tilt movement allowable angle limitation is achieved by the tilt angle limiting stopper unit 51 and the tilt angle limiting protruding unit 50.

Additionally, since the cover member 54 is provided during a tilt operation, foreign materials are prevented from entering the inside of the rotating member through-hole 414.

Figure 12:
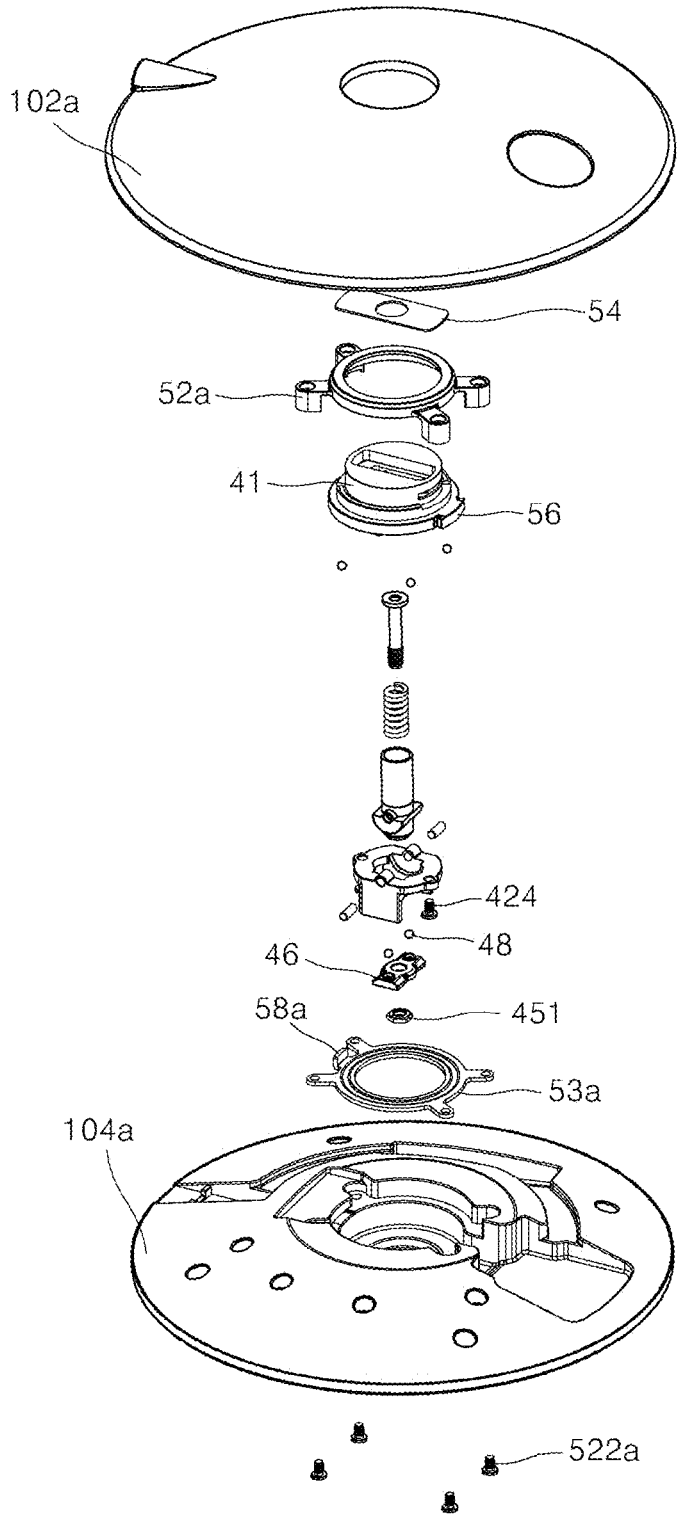
FIGS. 12 and 13 are exploded perspective views illustrating a modified configuration of a mutual connection relationship between a base unit and a base connection unit, when compared with a previous aspect.
Figure 13:
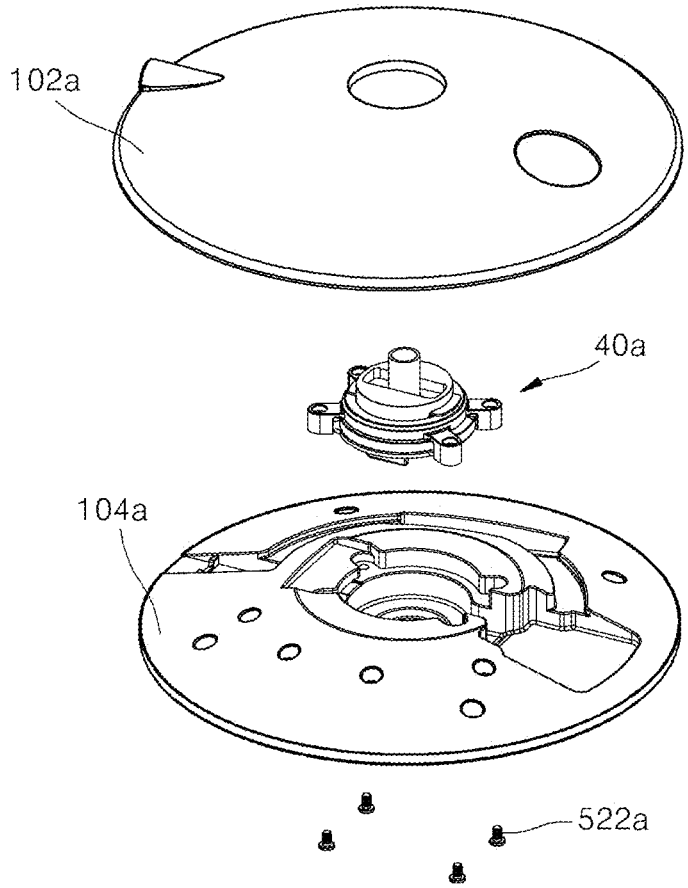

Moreover, somewhat another configuration of the mutual connection relationship between the base unit 10 and the base connection unit 40 of the lighting apparatus 1 in the above aspects of the disclosed embodiment is shown in FIGS. 12 and 13.

The base unit of FIG. 12 includes an upper case 102*a* and a lower case 104*a*. The configuration shown in FIGS. 12 and 13 is different from that of the above aspects of the disclosed embodiment, in that an entire configuration of the base connection unit 40*a* is fixed to the lower case 104*a*.

That is, according to the lighting apparatus of the above aspects of the disclosed embodiment, the first fixing member 52 of the base connection unit 40 is fixed to the upper case 102, and according to this aspect of the disclosed embodiment, the first fixing member 52*a* is fixed to the lower case 104*a* by the screw members 522*a*. At this point, the lower case 104*a* may be formed of a heavy and firm metal. With such a configuration, the base connection unit 40*a* having a physical movement may have more durability.

The configurations shown in FIGS. 12 and 13 may play the same roles as the corresponding configurations using the same reference numerals of the above aspects of the disclosed embodiment.

Figure 14:
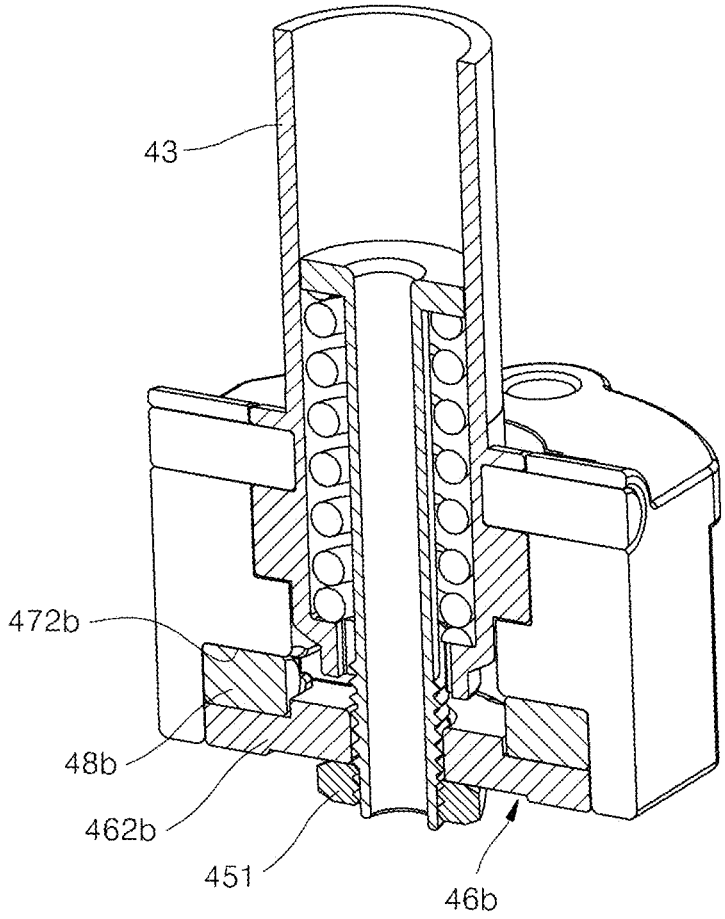
FIGS. 14 and 15 are stereoscopic cross-sectional views illustrating a modified configuration for allowing a relative movement of a holder extension unit and a cam unit to be smoother, when compared with a previous aspect.
Figure 15:
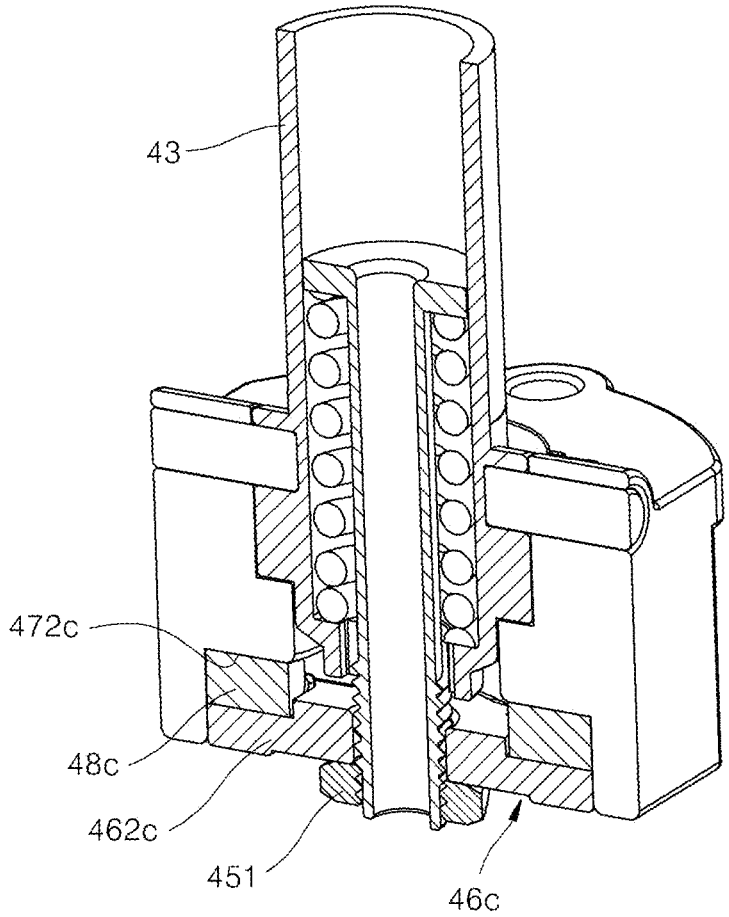

Moreover, FIGS. 14 and 15 are views illustrating a configuration for allowing a relative movement of the holder extension unit and the cam unit to be smoother.

In FIG. 14, when compared with the first aspect of the disclosed embodiment, there is a difference in that one cylindrical holder cylinder 48*b* that makes the relative movement of the holder extension unit 462*b* and the cam unit smooth is installed at each of both sides thereof between the holder extension unit 462*b* and the inclined plane 472*b* of the cam unit. That is, the two cylindrical holder cylinders 48*b* are provided. In the above aspect of the disclosed embodiment, instead of the holder cylinders, the metal sphere-shaped holder ball is provided. Therefore, when compared with that a mutually contacting portion is a point, according to the aspect of the disclosed embodiment of FIG. 14, in the case of the cylindrical holder cylinders 48*b*, the contacting portion is a line, so that it is possible to make a more stable movement.

Additionally, when compared with the above aspects of the disclosed embodiment, referring to FIG. 15, there is a difference in that a member 48*c* that makes the relative movement of the holder extension unit 462*c* and the inclined plane 472*c* of the cam unit smooth is installed at each of both sides thereof between the holder extension unit 462*c* and the inclined plane 472*c* of the cam unit. That is, the two members 48*c* are provided. That is, by appropriately configuring the form of the members 48*c*, a surface contact occurs at a portion where the inclined plane of the cam unit and the holder extension unit mutually contact. If a mutual movement occurs at a surface contact state, it is possible to make a more stable movement when compared with the previous aspects of the disclosed embodiment.

REFERENCE NUMERALS

| | | | |
|---|---|---|---|
| 1 | lighting apparatus | 10 | base unit |
| 20 | first rod-shaped member | 30 | lighting unit |
| 40 | base connection unit | 41 | rotating member |
| 42 | base cam | 43 | main shaft |
| 44 | elastic member | 45 | cam shaft |
| 46 | base cam ball holder | 47 | cam unit |
| 48 | holder ball | 52 | first fixing member |
| 53 | second fixing member | 54 | cover member |

The invention claimed is:

1. A lighting apparatus comprising:

a base unit placed on a floor or fixed at a wall;

a first rod-shaped member having one end coupled to the base unit and having a long shape in a lengthy direction;

a lighting unit installed at the other end of the first rod-shaped member and including a light source for emitting light; and a base connection unit installed at the base unit and coupled to the one end of the first rod-shaped member, wherein the base connection unit comprises:

a rotating member rotatably coupled to the base unit;

a base cam fixed to the rotating member and including a base cam through-hole that penetrates a central portion of the base cam;

a main shaft disposed in the base cam through-hole, capable of performing a tilt operation for rotating in one direction and the other direction on the basis of a tilt rotation central axis orthogonal to the lengthy direction of the first rod-shaped member, and having an upper portion to which the one end of the first rod-shaped member is coupled and fixed; and an elastic member that is provided to change an elastic bearing power applied to the main shaft, as the main shaft is tilted.

2. The lighting apparatus of claim 1, wherein:

the main shaft has a hollow cylindrical form and has a main shaft through-hole penetrating a lower portion of the main shaft;

the main shaft further comprises a cam shaft therein;

a lower portion of the cam shaft passes through the main shaft through-hole and extends;

the lower portion of the cam shaft further comprises a base cam ball holder including a holder extension unit protruding toward a direction vertical to the lengthy direction of the cam shaft;

the lighting apparatus further comprises a cam unit protruding toward an inside of the base cam through-hole and having an inclined plane whose distance to the tilt rotation central axis is changed gradually;

the elastic member is disposed at the inside of the main shaft, and the degree of the elastic deformation of the elastic member is changed according to a change of the distance between the base cam ball holder and the tilt rotation central axis as the cam shaft moves; and while the main shaft is tilted, the deformation degree of the elastic member is changed simultaneously as the holder extension unit moves along the camp unit, an elastic bearing power applied to the main shaft by the elastic member is changed.

3. The lighting apparatus of claim 2, wherein:

the cam shaft has an elongated body portion and a head portion having an expanded diameter at an upper end of the body portion;

the elastic member is a coiled spring and is inserted into the body portion of the cam shaft to be pressed by the head portion of the cam shaft; and the elastic member is pressed and elastically deformed further by the head part of the cam shaft, as the cam shaft moves and the base cam ball holder fixed at the lower end part of the body part of the cam shaft moves in a direction away from the rotation central axis.

4. The lighting apparatus of claim 2, wherein when a tilt operation of the main shaft is made toward the front side of a user, the holder extension unit becomes progressively away from the main shaft through-hole and the elastic member is further elastically deformed.

5. The lighting apparatus of claim 2, wherein the inclined plane of the cam unit is formed downward; and at least one metal sphere-shaped form holder ball that allows a relative movement of both sides to be smooth or at least one cylindrical holder cylinder is provided between the holder extension unit and the inclined plane of the cam unit.

6. The lighting apparatus of claim 2, wherein a tilt angle limiting stopper unit limiting a range of a tilt operation toward the front and rear sides of the main shaft is formed on at least one of the rotating member and the base cam.

7. The lighting apparatus of claim 2, wherein a screw thread formed at the lower end part of the cam shaft and coupled to a nut, the elastic member, the cam shaft, and the base cam ball holders are mutually coupled to each other.

8. The lighting apparatus of claim 1, further comprising a first fixing member fixed to the base unit and rotatably fixing and supporting the rotating member.

9. The lighting apparatus of claim 8, further comprising a second fixing member disposed on the bottom of the rotating member and fixed to the base unit to fix and support the lower side of the rotating member, wherein the lower side of the rotating member and the upper side of the second fixing member face each other mutually, and at least two metal sphere-shaped rotating member balls that allow a rotating movement of the rotating member to be smooth are provided between the lower side of the rotating member and the upper side of the second fixing member.

10. The lighting apparatus of claim 1, wherein the rotating member has a rotating member through-hole penetrating a central portion of the rotating member;

the rotating member comprises a plate-shaped cover member for covering the rotating member through-hole and moving with respect to the rotating member;

a through-hole penetrating the main shaft is formed in the cover member; and the cover member moves together with the main shaft inserted into the cover member through-hole as the main shaft is tilted, and is configured to prevent a penetrated portion of the rotating member through-hole from being exposed to the outside.

11. The lighting apparatus of claim 1, wherein in order to limit a rotation angle of a rotational movement with respect to the base unit of the rotating member, a rotation angle limiting protruding unit is formed at one of the base unit and the rotating member, and a rotation angle limiting stopper unit protruding to limit a movement of the protruding unit is formed at the other one of the base unit and the rotating member.

12. The lighting apparatus of claim 1, wherein:

an elongated second rod-shaped member is connected to the other end part of the first rod-shaped member and the first and second rod-shaped members are mutually connected to each other by a middle connection unit; and the lighting part is coupled to an end of the second rod-shaped member.

* * * * *